US008584753B2

(12) United States Patent
Fitzpatrick et al.

(10) Patent No.: US 8,584,753 B2
(45) Date of Patent: Nov. 19, 2013

(54) METHOD AND APPARATUS FOR CREATING AN ANNULAR BARRIER IN A SUBTERRANEAN WELLBORE

(75) Inventors: Harvey Joseph Fitzpatrick, Katy, TX (US); Andrew David Penno, Morlaas (FR)

(73) Assignee: Halliburton Energy Services, Inc., Houston, TX (US)

( * ) Notice: Subject to any disclaimer, the term of this patent is extended or adjusted under 35 U.S.C. 154(b) by 348 days.

(21) Appl. No.: 12/938,929

(22) Filed: Nov. 3, 2010

(65) Prior Publication Data

US 2012/0103607 A1 May 3, 2012

(51) Int. Cl.
*E21B 43/04* (2006.01)

(52) U.S. Cl.
USPC ..... 166/278; 166/51

(58) Field of Classification Search
USPC ..... 166/278, 300, 51, 179
See application file for complete search history.

(56) References Cited

U.S. PATENT DOCUMENTS

| | | | | |
|---|---|---|---|---|
| 4,921,047 | A * | 5/1990 | Summers et al. | 166/276 |
| 4,945,991 | A | 8/1990 | Jones | |
| 4,972,906 | A * | 11/1990 | McDaniel | 166/276 |
| 5,090,478 | A * | 2/1992 | Summers | 166/278 |
| 5,113,935 | A | 5/1992 | Jones et al. | |
| 5,341,880 | A | 8/1994 | Thorstensen et al. | |
| 5,375,661 | A | 12/1994 | Daneshy et al. | |
| 5,890,533 | A | 4/1999 | Jones | |
| 5,934,376 | A | 8/1999 | Nguyen et al. | |
| 6,003,600 | A | 12/1999 | Nguyen et al. | |
| 6,298,916 | B1 | 10/2001 | Tibbles et al. | |
| 6,427,775 | B1 | 8/2002 | Dusterhoft et al. | |
| 6,446,722 | B2 | 9/2002 | Nguyen et al. | |
| 6,481,494 | B1 | 11/2002 | Dusterhoft et al. | |
| 6,516,881 | B2 | 2/2003 | Hailey, Jr. | |
| 6,516,882 | B2 | 2/2003 | McGregor et al. | |
| 6,540,022 | B2 | 4/2003 | Dusterholft et al. | |
| 6,554,064 | B1 | 4/2003 | Restarick et al. | |
| 6,557,634 | B2 | 5/2003 | Hailey, Jr. et al. | |
| 6,557,635 | B2 | 5/2003 | Nguyen et al. | |
| 6,571,872 | B2 | 6/2003 | Dusterhoft et al. | |
| 6,581,689 | B2 | 6/2003 | Hailey, Jr. | |
| 6,601,646 | B2 | 8/2003 | Streich et al. | |
| 6,702,018 | B2 | 3/2004 | McGregor et al. | |
| 6,702,019 | B2 | 3/2004 | Dusterhoft et al. | |

(Continued)

OTHER PUBLICATIONS

PCT International Search Report and Written Opinion for PCT/US2011/058104, May 11, 2012.

*Primary Examiner* — Kenneth L Thompson
(74) *Attorney, Agent, or Firm* — Booth Albanesi Schroeder, LLC

(57) ABSTRACT

Presented is a method of completing a subterranean well having an open wellbore extending through a subterranean formation having a target zone. In a preferred embodiment, a tubing assembly is placed in the wellbore, extending through the target zone. An annular space is defined between the outer surface of the tubing assembly and the wellbore wall. A gravel pack is placed in the annular space along at least a length of the target zone. Then an annular barrier forming material is flowed into the annular space along at least a length of the target zone. Then the annular barrier forming material is "set" to create an annular barrier in the annular space. The annular barrier forming material can be carried on the tubing assembly or pumped downhole. Flow restrictors, such as packers or a gravel pack, can be used to restrict flow of the annular barrier forming material to allow the material to set into an annular barrier.

18 Claims, 5 Drawing Sheets

(56) References Cited

U.S. PATENT DOCUMENTS

| | | | |
|---|---|---|---|
| 6,715,545 | B2 | 4/2004 | McGregor et al. |
| 6,749,023 | B2 | 6/2004 | Nguyen et al. |
| 6,755,245 | B2 | 6/2004 | Nguyen et al. |
| 6,761,218 | B2 | 7/2004 | Nguyen et al. |
| 6,789,624 | B2 | 9/2004 | McGregor et al. |
| 6,814,139 | B2 | 11/2004 | Hejl et al. |
| 6,830,104 | B2 | 12/2004 | Nguyen et al. |
| 6,854,522 | B2 | 2/2005 | Brezinski et al. |
| 6,932,157 | B2 | 8/2005 | McGregor et al. |
| 6,935,432 | B2 | 8/2005 | Nguyen |
| 7,100,691 | B2 | 9/2006 | Nguyen et al. |
| 7,152,687 | B2 | 12/2006 | Gano |
| 7,216,706 | B2 | 5/2007 | Echols et al. |
| 7,243,724 | B2 | 7/2007 | McGregor et al. |
| 7,252,142 | B2 | 8/2007 | Brezinski et al. |
| 7,264,047 | B2 | 9/2007 | Brezinski et al. |
| 7,299,871 | B2 | 11/2007 | Hanes, Jr. |
| 7,299,882 | B2 | 11/2007 | Brezinski et al. |
| 7,320,367 | B2 | 1/2008 | Brezinski et al. |
| 7,334,639 | B2 | 2/2008 | Svoboda |
| 7,363,986 | B2 | 4/2008 | Brezinski et al. |
| 7,404,437 | B2 | 7/2008 | Brezinski |
| 7,407,007 | B2 | 8/2008 | Tibbles |
| 7,488,705 | B2 | 2/2009 | Reddy et al. |
| 7,562,709 | B2 | 7/2009 | Saebi et al. |
| 7,631,695 | B2 | 12/2009 | Schafer et al. |
| RE41,118 | E | 2/2010 | Brezinski et al. |
| 7,703,520 | B2 | 4/2010 | Dusterhoft |
| 7,784,532 | B2 | 8/2010 | Sevre et al. |
| 8,371,370 | B2 | 2/2013 | Xu |
| 2003/0188865 | A1 | 10/2003 | McGregor |
| 2005/0023003 | A1 | 2/2005 | Echols et al. |
| 2005/0039917 | A1 | 2/2005 | Hailey, Jr. |
| 2005/0121192 | A1 | 6/2005 | Hailey, Jr. et al. |
| 2006/0037752 | A1 | 2/2006 | Penneo |
| 2007/0017675 | A1* | 1/2007 | Hammami et al. ..... 166/278 |
| 2007/0114016 | A1 | 5/2007 | Brezinski |
| 2007/0114017 | A1 | 5/2007 | Brezinski |
| 2007/0114018 | A1 | 5/2007 | Brezinski |
| 2007/0114019 | A1 | 5/2007 | Brezinski |
| 2007/0114044 | A1 | 5/2007 | Brezinski |
| 2007/0267201 | A1 | 11/2007 | Brezinski |
| 2008/0128129 | A1 | 6/2008 | Yeh et al. |
| 2008/0251250 | A1 | 10/2008 | Brezinski |
| 2009/0137431 | A1 | 5/2009 | Reddy et al. |
| 2010/0041792 | A1 | 2/2010 | Roddy et al. |

* cited by examiner

METHOD AND APPARATUS FOR CREATING AN ANNULAR BARRIER IN A SUBTERRANEAN WELLBORE

CROSS-REFERENCE TO RELATED APPLICATIONS

None

FIELD OF INVENTION

The invention relates to apparatus and methods for creating annular barriers in the annular space between a tubing assembly and the wellbore, and more particularly, to creating an annular barrier downhole by flowing a settable material into the annular space and setting the settable material such that it creates an annular barrier capable of holding a pressure differential.

BACKGROUND OF INVENTION

It is well known that oil and gas wells pass through a number of zones other than the particular oil and/or gas zones of interest. Some of these zones may be water producing. It is desirable to prevent water from such zones from being produced with produced oil or gas. Similarly, it may be desirable to shut off gas flow from an oil-producing well, or vice versa. Where multiple oil and/or gas zones are penetrated by the same borehole, it is desirable to isolate the zones to allow separate control of production from each zone for most efficient production. External packers have been used to provide annular seals or barriers between production tubing and well casing to isolate various zones.

It has become more common to use open hole completions in oil and gas wells. In these wells, standard casing is cemented only into upper portions of the well, but not through the producing zones. A tubing assembly or string is then run from the bottom of the cased portion of the well down through the various production zones. As noted above, some of these zones may be zones producing undesired fluids, such as, for example, water zones, which must be isolated from any desirable produced fluids. The various production zones often have different natural pressures and must be isolated from each other to prevent flow between zones and to allow production from the low pressure zones or from only selected zones.

Open hole completions are particularly useful in slant hole wells. In these wells, the wellbore may be deviated and run horizontally for thousands of feet through a producing zone. It is often desirable to provide annular barriers along the length of the horizontal production tubing to allow selective production from, or isolation of, various portions of the producing zone.

In open hole completions, various steps are usually taken to prevent collapse of the borehole wall or flow of sand from the formation into the production tubing. Use of gravel packing and sand screens are common ways of protecting against collapse and sand flow. More modern techniques include the use of expandable solid or perforated tubing and/or expandable sand screens. These types of tubular elements may be run into uncased boreholes and expanded after they are in position. Expansion may be by use of known methods in the art, including for example, inflatable bladders, use of an expansion cone, swellable material expansion, etc., in the tubular members. However, in many cases, due to irregularities in the borehole wall or simply unconsolidated formations, expanded tubing and screens will not prevent annular flow in the borehole. For this reason, annular barriers as discussed above are typically needed to significantly reduce or stop annular flow, even against significant differential pressure, in the borehole.

Use of conventional external casing packers for such open hole completions presents a number of problems. They are significantly less reliable than internal casing packers, they may require an additional trip to set a plug for cement diversion into the packer.

Efforts have been made to form annular barriers in open hole completions by placing a rubber sleeve on expandable tubing and screens and then expanding the tubing to press the rubber sleeve into contact with the borehole wall. These efforts have had limited success due primarily to the variable and unknown actual borehole shape and diameter. The thickness of the sleeve must be limited since it adds to the overall tubing diameter, which must be limited to allow the tubing to be run into the borehole. The maximum size must also be limited to allow tubing to be expanded in a nominal or even undersized borehole. In washed out or oversized boreholes, normal tubing expansion is not likely to expand the rubber sleeve enough to contact the borehole wall and form a seal. To form an annular seal or barrier in variable sized boreholes, adjustable or variable expansion tools have been used with some success. However it is difficult to achieve significant stress in the rubber with such variable tools and this type of expansion produces an inner surface of the tubing which follows the shape of the borehole and is not of substantially constant diameter.

In light of these difficulties, advancements in methods and apparatus for forming annular barriers in an open borehole are discussed in U.S. Pat. No. 6,854,522 to Brezinski, et al., entitled ANNULAR BARRIERS FOR EXPANDABLE TUBULARS IN WELLBORES, issued Feb. 15, 2005, which is incorporated herein by reference for all purposes.

Use of expandable tubing is not always desired or possible, however. Consequently, a method and apparatus for forming annular barriers in open hole boreholes without use of expandable tubing is desirable. It is desirable to provide equipment and methods for installing annular barriers in open boreholes, particularly horizontal boreholes, which provide a seal between production tubing and the wall of open boreholes.

SUMMARY

Presented is a method of completing a subterranean well having an open wellbore extending through a subterranean formation having a target zone. In a preferred embodiment, a tubing assembly is placed in the wellbore, extending through the target zone. An annular space is defined between the outer surface of the tubing assembly and the wellbore wall. A gravel pack is placed in the annular space along at least a length of the target zone. Then an annular barrier forming material is flowed into the annular space along at least a length of the target zone. Then the annular barrier forming material is "set" to create an annular barrier in the annular space.

In one embodiment, the annular barrier forming material is stored in a compartment in the tubing assembly and carried downhole. Alternately, the annular barrier forming material is pumped downhole from the surface to the annular space and then into the annular space adjacent the target zone. As used herein, "target zone" can mean a single or multiple geological layers of media, such as layers 20-24, producing or non-producing regions or zones along the wellbore, a completion interval, etc.

In a preferred embodiment, at least one flow restrictor is positioned in the target zone, such as a packer. The flow restrictor can be used to seal against flow in the annular space and can be employed to restrict flow of the annular barrier forming material. The restriction allows the material to "set" in the selected location in the wellbore. The annular barrier forming material can be flowed into the annular space uphole or downhole from the flow restrictor. The flow restrictor can be set before or after gravel packing the wellbore. In another embodiment, the gravel pack acts as a flow restrictor.

The annular barrier forming material can comprise a polymer, silicone, resin or other material as discussed herein. Further, the annular barrier forming material can comprise multiple chemical compounds which are mixed together downhole. A catalyst can be used to set the annular barrier forming material. The catalyst, compounds or other barrier forming materials can be delivered from compartments on the tubing assembly or by pumping from the surface. Further, the catalyst or a reactive chemical compound can be located in situ, such as water or hydrocarbons.

The annular barrier forming material sets in the annular space to form an annular barrier. The material can set in response to a change of temperature, passage of time, in response to a catalyst, etc.

The method can be used in injection or production wells.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF PREFERRED EMBODIMENTS

Figure 1:
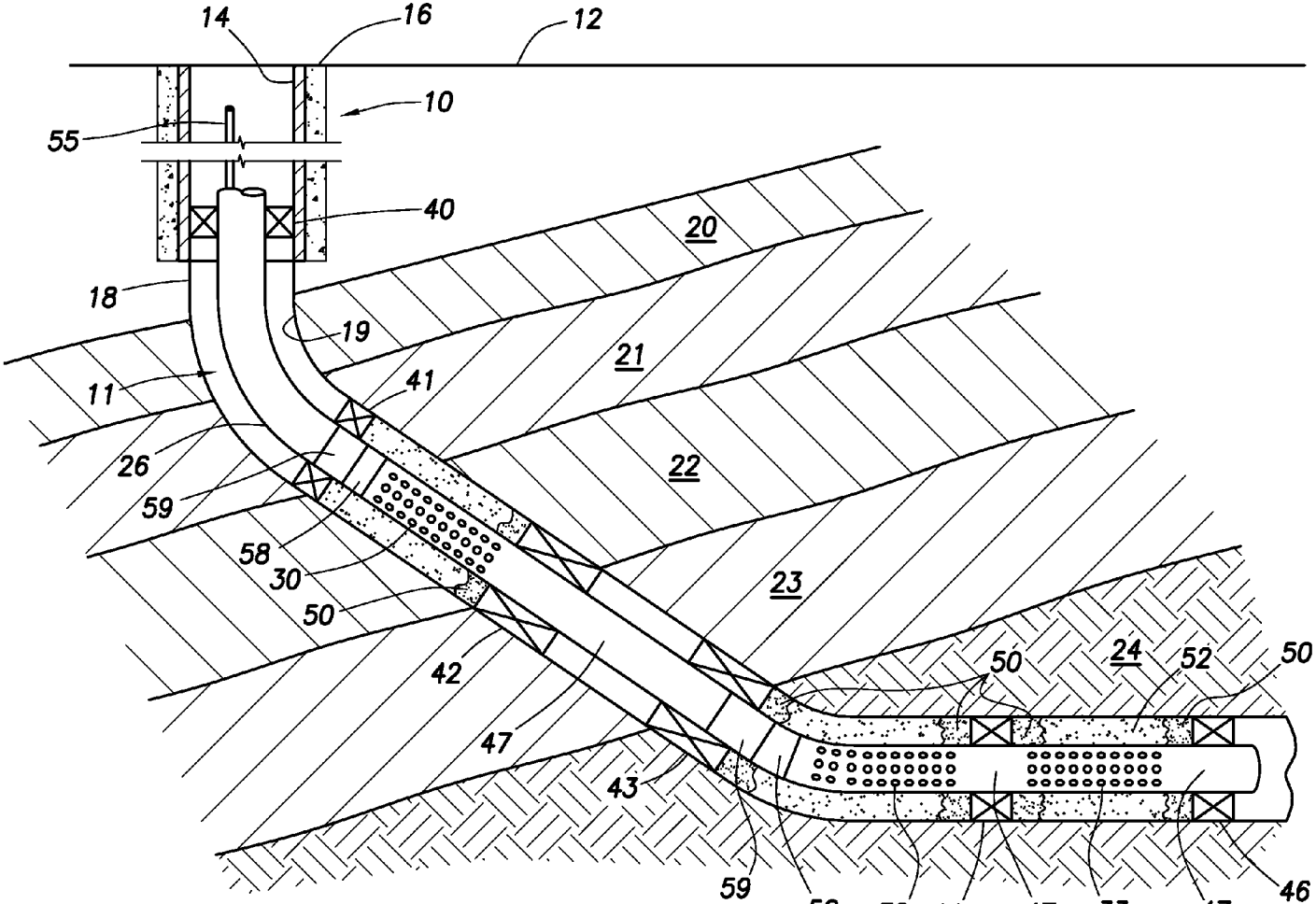
FIG. 1 is a cross-sectional view of a borehole in the earth with an open hole completion and a number of annular barriers according to the present invention.

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not delimit the scope of the present invention.

The term "annular barrier" as used herein means a material or a combination of materials which blocks or prevents flow of fluids from one side of the barrier to the other in the annulus between a tubular member in a well and a borehole wall. An annular barrier is capable of holding against a differential pressure between two portions of the annulus. Since annular barriers must block flow in an annular space, they may have a ring like or tubular shape having an inner diameter in contact with the outer surface of a tubular member and having an outer diameter in contact with the inner wall of a borehole or casing. It is understood that, in practice, it may be difficult to provide a perfectly fluid-tight seal in the annular space, particularly in an open borehole. Consequently, an annular barrier may still "leak" fluid around the barrier, however, the barrier must hold against differential pressure and provide a barrier to substantial fluid flow. For purposes of this document, an annular barrier is distinct from a packer or other mechanical barrier formed in an annulus. An annular barrier formed by an annular barrier forming material as described herein can be used in conjunction with packers and other mechanical barriers. A barrier may extend for a substantial length along a borehole.

The term "perforated" as used herein, e.g., perforated tubing, perforated liner, perforated tubing section, etc., means that the member has holes or openings through it. The holes can have any shape, e.g., round, rectangular, slotted, etc. The term does not limit the manner in which the holes are made, i.e. it does not require that they be made by perforating with "guns" or shaped charges, pre-perforated before placement in the borehole, etc. Nor is the term intended to limit or describe the particular arrangement of the holes in the tubular wall.

Conversely, the term "blank" as used herein, e.g., blank tubing, blank tubing section, blank liner, etc., means that the tubular member is not perforated. Blank assemblies may include the addition of fluid flow conduits which can provide a secondary flow path for conveying treatment fluids along the length of the blank assembly to a section of screen assembly where the fluids can be deployed for their intended use.

The term "screen" or "screen assembly" as used herein refers to a screen, usually of metal, placed around or forming a tubular for preventing or reducing the production of unwanted solid materials from the formation, such as sand or fines, while allowing production of fluids. Screen assemblies are known and used in the art, are commercially available, and will be understood by those in the art. Screen assemblies can include screens and/or filters. Screen assemblies often have perforated shrouds exterior to the screen. As used herein, a "screen assembly" is a type of "perforated tubing assembly," "perforated tubing section," "perforated section," and the like. Screen assemblies may include fluid flow conduits which provide a secondary flow path for placing treatment fluids along the length of the screen assembly. An example use of these would be placement of gravel pack slurry to obtain more uniform packing along the length of the screen.

The terms "gravel" and "gravel pack" are terms of art and are understood by those of skill in the art. A gravel pack is a mass of very fine gravel or sand placed in the wellbore annulus. Gravel packing is a method of well completion in which a slotted or perforated liner or sand screen assembly is placed in the well and surrounded by gravel. The gravel prevents or reduces sand or fines production but allows continued rapid production of hydrocarbon fluids. The gravel pack is porous and permeable to allow production of fluids. Methods of gravel packing are not taught herein in detail and are known in the art.

The term "tubing assembly" as used herein means a tubing string, as that term is understood on the art. The tubing assembly can include multiple tubular elements which are strung together to create a tubing string which is run into the wellbore. The tubing assembly can include many elements, including tubing, downhole tools, perforating devices, joints, sealing devices, collars, etc. The tubing assembly can include jointed tubing or coiled tubing.

With reference now to FIG. 1, there is provided an example of a producing oil well in which an annular barrier according to the present invention is useful. In FIG. 1, a borehole 10 has been drilled from the surface of the earth 12. An upper portion of the borehole 10 has been lined with casing 14 which has been cemented into the borehole 10 by cement 16. Below the cased portion of borehole 10 is an open hole portion 18 which extends downward and then laterally through various earth formations. For example, the borehole 18, having a wellbore wall 19, may pass through a water bearing zone 20, a shale layer 21, an oil bearing zone 22, a nonproductive zone 23 and into another oil bearing zone 24. As illustrated in FIG. 1, the open hole 18 has been slanted so that it runs through the zones 20-24 at various angles and may run essentially horizontally through oil-bearing zone 24. Slant hole or horizontal drilling technology allows such wells to be drilled for thousands of feet away horizontally from the surface location of a well and allows a well to be guided to stay within a single zone if desired. Wells following an oil bearing zone will seldom be exactly horizontal, since oil bearing zones are normally not horizontal.

Tubing assembly 26 has been placed to run from the lower end of casing 14 down through the open hole portion of the well 18. At its upper end, the tubing assembly 26 is sealed to the casing 14 by a packer 40 or similar mechanical device. Another packer 41 seals the annulus between tubing assembly 26 and the wall 19 of borehole 18 within the shale zone 21. It can be seen that packers 40 and 41 prevent annular flow of fluid from the water zone 20 and thereby prevent production of water from zone 20. Within oil zone 22, tubing assembly 26 has a perforated section 30. Section 30 may be a perforated liner and may typically carry sand screens or filters about its outer circumference. A pair of packers 42 and 43 prevents annular flow to, from or through the nonproductive zone 23. The combination of packer 41 and packers 42 and 43 allow production from oil zone 22 into the perforated tubing section 30 to be selectively controlled and prevents the produced fluids from flowing through the annulus to other parts of the borehole 18.

Within oil zone 24, tubing assembly 26 is illustrated as having two perforated sections 32 and 33. Sections 32 and 33 may typically carry sand screens or filters about their outer circumference. Packers 44 and 46 are provided to seal the annulus between the tubing assembly 26 and the wall 19 of open borehole 18. The packers allow separate control of flow of oil into the perforated sections 32 and 33 and prevent annular flow of produced fluids to other portions of borehole 18. The horizontal section of open hole 18 may continue for thousands of feet through the oil bearing zone 24. The tubing assembly 26 may likewise extend for thousands of feet within zone 24 and may include numerous perforated sections which may be divided by numerous packers to divide the zone 24 into multiple areas for controlled production.

Numerous blank sections of tubing are used along portions of the wellbore where production is not desired. For example, blank sections 47 are shown straddling the non-productive zone 23, and extending across packers 43, 44 and 46.

In open hole completions, various steps are usually taken to prevent collapse of the borehole wall or flow of sand from the formation into the tubing assembly. Use of gravel packing is typical to protect against collapse and sand flow. In FIG. 1, gravel packs 52 are shown in the well annulus between the tubing assembly 26 and wellbore wall 19 along the portions of the well corresponding to perforated sections 30, 32 and 33.

While packers or similar devices 41, 42, 43 and 46, may be sufficient to prevent annular flow of fluids, it is often the case that these devices are insufficient in open-hole wellbores due to the lack of consolidation of the formation, collapses of the wellbore, irregularities of the wellbore wall, etc. Expandable tubulars and screens can be used, but again, may not create a complete or sufficient annular barrier. Consequently, the inventions described herein provide a method for creating an annular barrier without use of expandable tubulars. There is a need for a method of creating an annular barrier in a gravel-packed, open-hole wellbore. Presented herein is a method of creating an annular barrier forming material which is delivered into the well annulus as a fluid and then "sets" into an annular barrier.

In FIG. 1, annular barriers 50 are shown uphole from packers 42 and 46, downhole from packers 43, and both up and downhole from packer 44. The annular barriers 50 provide a seal in the annular space formed between the tubing assembly 26 and the wellbore wall 19.

The annular barriers 50 are formed by annular barrier forming material 54, which is flowed into the annular space between the tubing assembly 26 and the wellbore wall 19. In a preferred embodiment, the annular barrier forming material 54 is in a fluid state, such as a liquid or gel, when flowed into the annular space. The annular barrier forming material is "settable" and "sets" once in the annular space as shown to create an annular barrier.

The annular barrier forming material can be a polymer, elastomer, rubber, resin, silicone, an acid-base cement, or other materials. For example, acceptable substances may include RTV silicone sealant, Dow (trademark) 730 sealant, or PR 1005 L synthetic rubber, etc., which are commercially available. Further examples of materials for the annular barrier forming material include viscous liquid polymer, vinyl or activated vinyl monomers, as taught in U.S. Pat. No. 7,299,871 to Hanes, which is incorporated herein by reference for all purposes. Alkali latex materials can be used, as taught in U.S. Pat. No. 7,488,705 to Reddy, which is incorporated herein by reference for all purposes. Latex compositions comprising pozzolan and/or cement kiln dust are taught in U.S. Patent Publicatoin No. 2010/0041792, to Roddy, et al., which is incorporated herein by reference for all purposes.

It is preferred that the annular barrier forming material, once in place in the annulus, cure or set within hours or days. Longer times may be used.

The annular barrier forming material 54 can be carried downhole in any state, including as a solid, powder, gel, liquid, slurry, or a mixture. When in a solid or powder state, for example, the material 54 is either mixed with a liquid, transformed to a liquid state, a slurry with suspended particles, etc., for delivery into the annulus. For example, if the material 54 is a solid or powder, it may react in the presence of water and liquefy. U.S. Pat. No. 6,854,522 provides an example and is incorporated herein for all purposes. The material can be introduced to a mixing liquid, whether water, petroleum liquids, or other, from the wellbore or from the tubing assembly. Such chemical compounds can react with ambient fluids to become viscous, semi-solid or solid once in the annular space. As another example, the material 54 can be in a solid state as carried downhole and transformed to a liquid or gel, such as by application of heat from the downhole environment or from a heater carried on the tubing assembly. Once in the annular space, the material will set, by solidifying or having mechanical properties sufficient to seal and isolate fluid flow in the annulus, thereby creating an annular barrier.

The annular barrier forming material can be a polyacrylamide or other material which reacts with water or another fluid to form a thick fluid. In such a case, the material can be carried downhole in a compartment and either flowed into the wellbore and exposed to the water or other fluid, or the material can be exposed to water or fluid also carried on the tubing assembly. Alternately, the material can be flowed into the wellbore from the surface using a pumping assembly, then exposed to the water or other fluid once in the wellbore annulus.

The annular barrier forming material 54 can also be created from a plurality of chemicals. For example, two chemical compounds, which, when mixed, react to form a solid, semi-solid or plastic material can be delivered to the selected location downhole. The chemical compounds can be mixed upon flowing into the annular space or mixed within the tubing assembly and then flowed into the annular space. Once mixed, the chemical compounds create an annular barrier 50 by solidifying or having sufficient mechanical properties to stay in place and create an effective barrier.

For many embodiments it is desirable that the annular barrier forming material be a fluid placed in the annulus to form an annular barrier which is very viscous or be able to change properties when exposed to available fluids in the well annulus. Thixotropic materials which are more viscous when stationary than when being pumped may also provide advantages. Various silicone materials are available with these desirable properties. Some are cured or set by contact with water and become essentially solid. A condensate curing silicone material may be injected into the annulus. Such a curable or settable viscous silicone material will conform to any borehole wall contour and fill micro-fractures and porosity some distance into the borehole wall 19 which might otherwise cause leakage.

The term "settable material" as used herein refers to any suitable fluid material which will "set up" under predetermined conditions to seal off the annulus and prevent fluids produced from the formation from moving upwardly axially along the annulus 11. It is necessary that the settable material remain fluid for pumping, injecting, or flowing into the annulus at the desired location, and then set up within a predetermined period of time, such as within a few hours or days. The setting process may take several days, or, for example, up to ten days. However, a shorter setting time is preferred, especially in wellbores requiring other well treatments soon after the formation of the annular barrier. Also note that the material may set sufficiently for the purposes of creating the annular barrier, but then continue to set or cure further over longer periods of time. The relevant time period for purposes of this document is the time period from flowing into the annulus until the annular barrier sets sufficiently to restrict annular flow of fluid in the wellbore annulus. Where the material is pumped from the surface, it is necessary to stay fluid during the pumping process as well, through the tubing assembly 26 or conduit 55 to the downhole location. Preferably, the settable material should not be miscible with water and is resistant to attack by any organic or inorganic acids which may be utilized for re-completion or for well treatment. A suitable settable material is Epseal, a pumpable epoxy resin composition sold by Halliburton Energy Services, some embodiments of which are disclosed in U.S. Pat. Nos. 3,960,801 and 4,072,194 which are incorporated herein by reference for all purposes. Epseal may be weighted, e.g., by filling with spherelite or other filler, to the desired density. The annular barrier forming material may be introduced into the wellbore annulus over a short distance, such as two linear feet, or over a longer distance, such as about 20 feet of the annulus, depending on the criteria for the treatment.

The annular barrier material can be "set" by various setting mechanisms. For example, the settable annular barrier forming material can set with the simple passage of time. Other examples are materials which set upon reaching a certain temperature, pressure or a combination of both. In such an example, the material is fluid while flowed into the annulus and sets in the annulus, becoming solid, semi-solid, or otherwise having mechanical properties sufficient to maintain the barrier location and restrict fluid flow in the annulus. In such a case, the ambient temperature and pressure of the wellbore can act as the trigger causing the material to set.

In another embodiment, the annular barrier forming material is set by reaction with a catalyst. For example, an annular barrier forming material, fluid upon entry into the annulus, can set upon contact with an ambient fluid in the annulus (water, petroleum products, in situ hydrocarbons, etc.). Alternately, a catalyst material can be injected or flowed into the annulus after or during injection of the settable material, causing the material to set. In a preferred embodiment, the annulus is partly filled with a chemical compound which will react with a second chemical compound. When the second compound is flowed into the annulus, the two chemical compounds are mixed and react to form an annular barrier.

Alternately, the annular barrier forming material can be carried downhole in capsules or microcapsules. The capsules are covered in a shell material which releases the annular barrier forming material when the shell dissolves, melts or otherwise releases the annular barrier forming material.

The annular barrier 50, once in place, can be solid, semi-solid, plastic, or otherwise have mechanical properties sufficient to create an effective annular barrier. Preferably the barrier maintains an effective annular seal even where the borehole changes in shape over the course of time.

The viscosity and other characteristics of the annular barrier forming material in its fluid state are selected based on the parameters of intended use. The initial viscosity of the annular barrier forming material 54 can be selected based on the well conditions, including whether a gravel pack is in place, the type of gravel pack, whether the gravel pack completely or partially fills the annular space, whether a screen assembly is in place, the permeability and porosity of the formation, the angle of deviation of the wellbore, the presence of packers, etc. For example, a relatively more viscous fluid may be used where little or no gravel pack or other media is in place in the wellbore annulus so that the fluid is restricted by its viscosity from flowing away from the desired location before setting properly. Where the annular barrier forming material is flowed into a wellbore having a gravel pack or other resident media in the annular space, it may be desirable that the annular barrier forming material, in it fluid state, be of relatively low viscosity when flowed into the annulus and through the permeable gravel pack, but once in place, become highly viscous quickly, and eventually solid or semi-solid as part of the setting process.

Similarly, the time period for setting the annular barrier forming material may be selected based on the parameters of the wellbore and intended use. The setting conditions and period for setting of the annular barrier forming material 54 can be selected based on the well conditions, including whether a gravel pack is in place, the type of gravel pack, whether the gravel pack completely or partially fills the annular space, whether a screen assembly is in place, the permeability and porosity of the formation, the angle of deviation of the wellbore, the presence of packers, etc. For example, a relatively short setting period may be required in applications without a packer to restrict flow of the annular barrier forming material while still in its fluid-state. Longer time periods for setting may be used where a packer or other flow restriction restricts the fluid from flowing away from the desired location.

The annular barrier forming material 54 can be delivered to the annulus at the selected location by a number of methods. For example, the annular barrier forming material can be carried downhole on the tubing assembly 26, such as in a downhole compartment 58, as seen in FIG. 1, such as bags, tubes, annular compartments, tanks, recesses, etc., which hold the material during the downhole trip. The annular barrier forming material 54 is then flowed into the annulus at the desired location. The compartment can be opened by any known mechanism in the art, such as a sliding sleeve, breakable seal, a port or ports which can be selectively opened, etc. The annular barrier forming material 54 can be flowed from the compartment 58 and into the wellbore annulus by any known method. As used herein, the step of "flowing into the wellbore" (and similar), is meant to encompass forced flow of a fluid, such as by injection, pump, actuator, hydraulic force expansion, etc., and also to include flow caused by gravity, chemical reaction, chemically-induced expansion and the like.

A downhole actuator assembly 59 can be used for this purpose. Downhole actuator assemblies are known in the art. The actuator assembly can be of any type known in the art, including self-contained setting tools, such as the Baker (trademark) propellant-based setting tool, hydrostatic tools, hydraulic setting tools, an actuator driven by a downhole power unit (DPU), setting tools manipulated from the surface, mechanically operated tools, etc. Note that the downhole actuator 59 can include various other devices, such as valving, tubing, control mechanisms, communication assemblies, and the like, not shown here, for operation of the tool, connection to the fluid compartment, etc.

Alternately, the annular barrier forming material 54 can be a fluid pumped down from the surface 12 through a conduit 55, or through the tubing assembly 26. In such an embodiment, appropriate pumping assemblies at the surface can be utilized as are known in the art. Apparatus and methods for pumping fluids downhole and into an annular space are well known in the art and will not be described in detail here.

Figure 2:
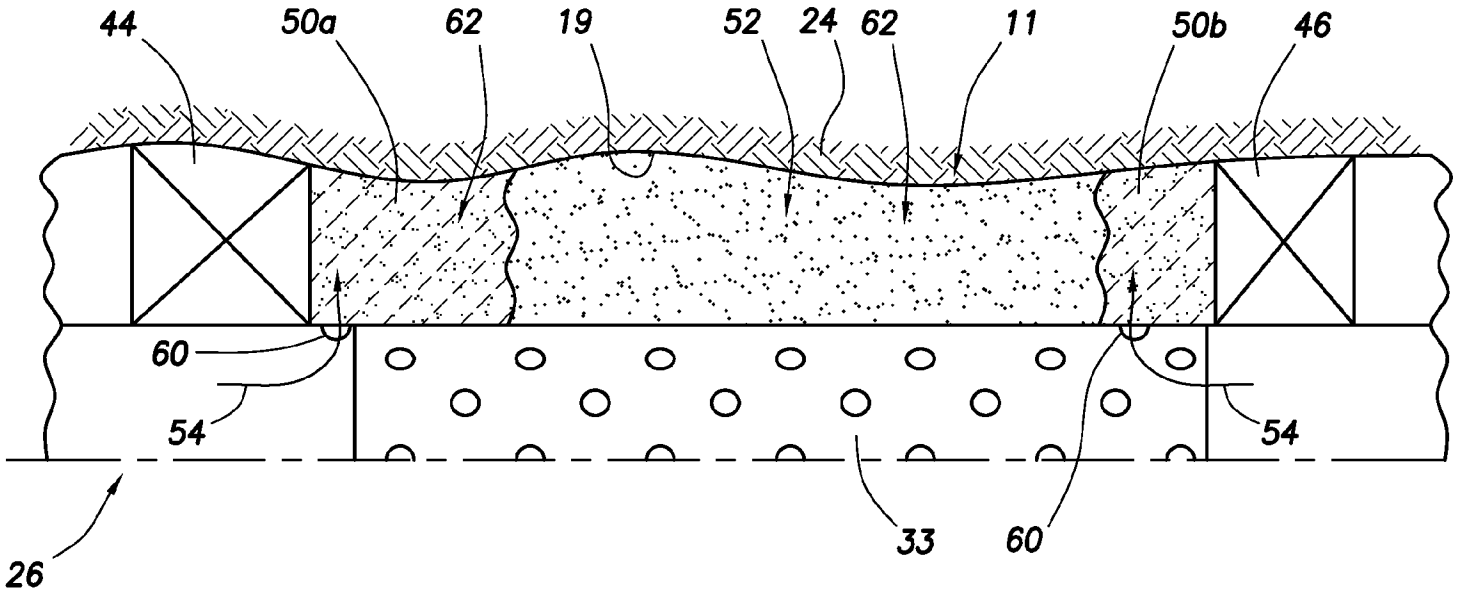
FIG. 2 is a cross-sectional view of an open hole wellbore, showing a tubing assembly and an embodiment of the invention.

FIG. 2 is a cross-sectional view of an open hole wellbore, showing a tubing assembly and an embodiment of the invention. The open hole wellbore 18, having wall 19, extends through a zone of a formation 24. The tubing assembly 26 extends through the wellbore 18 defining an annular space or annulus between the tubing assembly exterior and the wellbore wall 19. A perforated section 33 of tubing is positioned in the wellbore adjacent the selected zone. It is to be understood that a screen assembly can be used in place of or in conjunction with the perforated section. Packers 44 and 46, or other mechanical isolators, are set in the annulus. A gravel pack 52 has then been placed into the annular space. Methods for gravel packing are well known in the art and will be evident to those of skill in the art.

After placement of the gravel pack 52, the annular barrier forming material 54 is flowed into the annular space 11. Flow of the annular barrier forming material is represented by arrows in the Figure, however, the flow path is not intended to be limited to only the path shown by the arrows. The annular barrier forming material 54 sets once in the annular space and creates an annular barrier 50*a* and 50*b*. The annular barrier forming material 54 can be flowed into the annular space through ports or openings 60. Alternately, the annular barrier forming material 54 can be delivered into the annulus 11 through the perforated tubing assembly. The material can be delivered by a pump-down system from the surface or from storage compartments carried on the tubing assembly as described elsewhere herein.

In the embodiment in FIG. 2, the annular barrier forming material 54 is used in conjunction with packers 44 and 46. The material 54, in its fluid state, is flowed into the annular space 11 adjacent each packer 44 and 46, and sets into annular barriers 50*a* and 50*b*. The annular barrier can about the packer as shown. The fluid material 54 can be flowed into the annular space near both packers simultaneously or sequentially.

In FIG. 2, the two annular barriers 50*a* and 50*b* are shown in the section of annular space 11 between the packers 44 and 46. It is possible to position one or both of the annular barriers on the opposite side of the packers shown.

Additionally, FIG. 2 shows annular barrier forming material 54 used in conjunction with gravel pack 52. The gravel pack 52 includes packing media 62 which is positioned in the wellbore annular space 11 either completely or partially filling the space. The gravel pack media 62 creates a porous and permeable gravel pack 52. The annular barrier forming material 54, in its fluid state during flow into the annular space 11, flows through the permeable gravel pack 52. During the setting process, the material 54 sets with at least some of the gravel pack media 62 positioned in the resulting annular barrier 50. This allows creation of an effective annular barrier in an annular space already packed with gravel. Alternately, the same method can be used to create an annular barrier in an annular space which has collapsed or partially collapsed and contains formation media, such as sand, gravel, shale and the like.

In some preferred embodiments, the annular barrier forming material is selected to utilize the gravel pack media (or in situ media) as a structural component of the resulting annular barrier. The annular barrier forming material can be selected to create an effective barrier based solely on its properties; that is, the resulting barrier, even with no media present in the annular barrier, is sufficient to seal the annulus and/or support the open hole wellbore. Alternately, the material can be selected to incorporate the in situ media as a structural component; that is, the set material would not be sufficient on its own to create or hold a seal, but with the media 62 trapped in the set barrier, as seen at 50*a* and 50*b*, the properties of the combined set annular barrier and media 62 create an effective seal.

Further, the gravel pack or in situ media can be utilized to slow flow of the fluid-state annular barrier forming material to allow proper setting to occur. That is, the fluid material 54 may drain off or flow away from its intended location without the presence of the media, but remain in place for sufficient time to allow setting of the material into an annular barrier where media is present.

Figure 3:
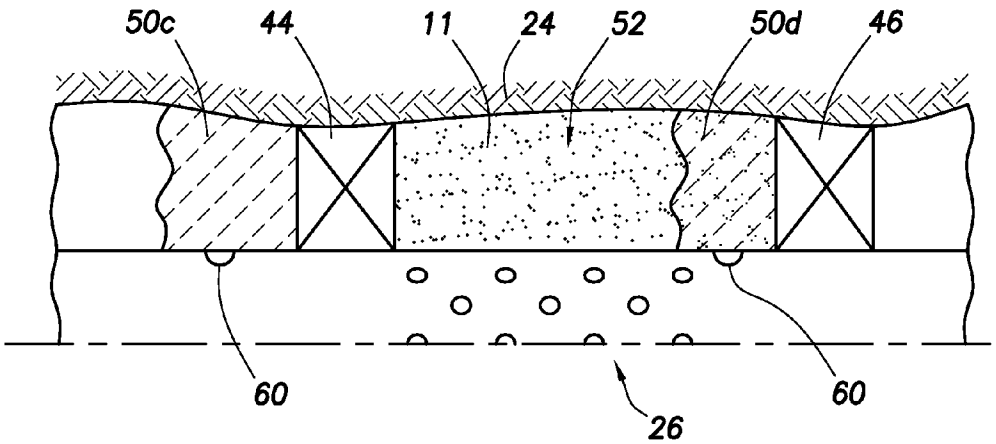
FIG. 3 is a cross-sectional view of an open hole wellbore having annular barriers formed by a method of the invention.

FIG. 3 is a cross-sectional view of an open hole wellbore having annular barriers formed by a method of the invention. FIG. 3 shows an alternate embodiment which may be advantageous, especially in wellbores which are deviated from the horizontal causing the annular barrier forming material (or annular barrier) to flow downhole in the annulus. For example, as shown in FIG. 3, an annular barrier 50*d* is positioned uphole from packer 46 and another barrier 50*c* is formed uphole from packer 44. ("Uphole" is used herein to indicate the direction in the wellbore towards the surface.) FIG. 3 also shows formation of annular barriers in a section of wellbore in which a gravel pack 52 is positioned, as with annular barrier 50*d* adjacent packer 46, and in a section of the wellbore without a gravel pack, as with annular barrier 50*c* adjacent the packer 44. If desired, annular barrier forming material can be placed into the annular space on both the uphole and downhole sides of a single packer or packer assembly to create annular barriers.

The annular barrier forming material can be flowed into the wellbore annulus on either side (uphole or downhole) from the packer or flow restrictor. Further, the annular barrier material may be positioned on the side of the packer wherein gravel pack is present or on a side of the packer wherein the annulus is substantially free of gravel pack media.

Figure 4:
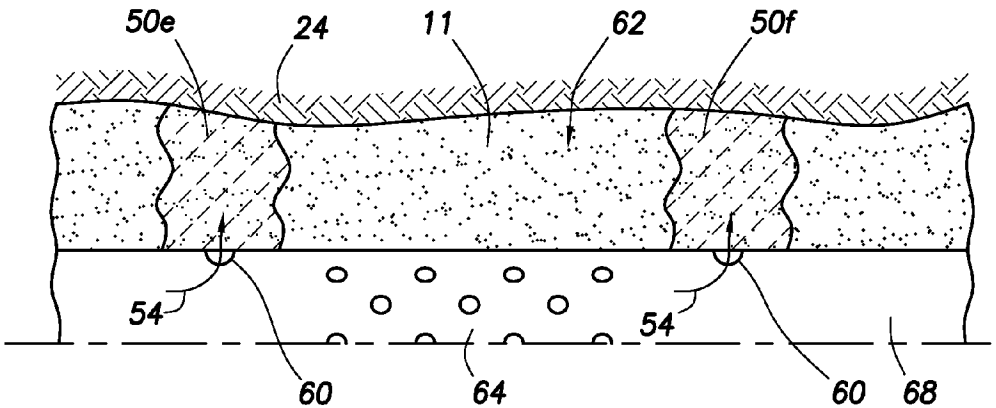
FIG. 4 is a cross-sectional view of an open hole section of a wellbore, showing a tubing assembly and an embodiment of the invention.

FIG. 4 is a cross-sectional view of an open hole section of a wellbore, showing a tubing assembly and an embodiment of the invention. The open hole wellbore 18 has a tubing assembly 26 extending through it. A gravel pack 52 has been placed into the annular space 11 between the tubing assembly and the wellbore wall 19. The gravel pack 52 comprises gravel pack media 62 which at least partially fills the annular space. The tubing assembly 26 includes a perforated section 64 and blank sections 66 and 68. The blank sections are shown with ports 60 for allowing annular barrier forming material 54 in a fluid state to flow from the tubing assembly and into the annular space 11. Alternately, the fluid material can be flowed into the annular space through the perforations of the perforated tubing section. Annular barriers 50*e* and 50*f* are created by flowing annular barrier forming material, in a fluid state, into the annular space, and then setting the material.

The initial viscosity and setting characteristics of the annular barrier forming material are selected based on the extent and type of gravel pack present. In the embodiment having a gravel pack, but no packers, it is desirable to select a material which sets quickly once in place. The initial viscosity is selected based on the permeability of the gravel pack and other factors to allow sufficient flow into the gravel pack so the annular barrier forming material reaches its desired location. The gravel pack is used to sufficiently slow or restrict flow of the annular barrier forming material so it sets into a barrier while still properly positioned in the wellbore.

During the setting process, the annular barrier forming material 54 sets with at least some of the gravel pack media 62 trapped in the resulting annular barriers 50*e* and 50*f*. This allows creation of an effective annular barrier in an annular space already packed with gravel. Alternately, the same method can be used to create an annular barrier in an annular space which is collapsed, partially collapsed, or otherwise contains formation media, such as sand, gravel, shale and the like. As explained herein, the annular barrier forming material may be selected to utilize the gravel pack media (or in situ media) as a structural component of the resulting annular barrier. Further, the gravel pack or in situ media can be utilized to restrict flow of the fluid-state annular barrier forming material to allow proper setting to occur.

Figure 5:
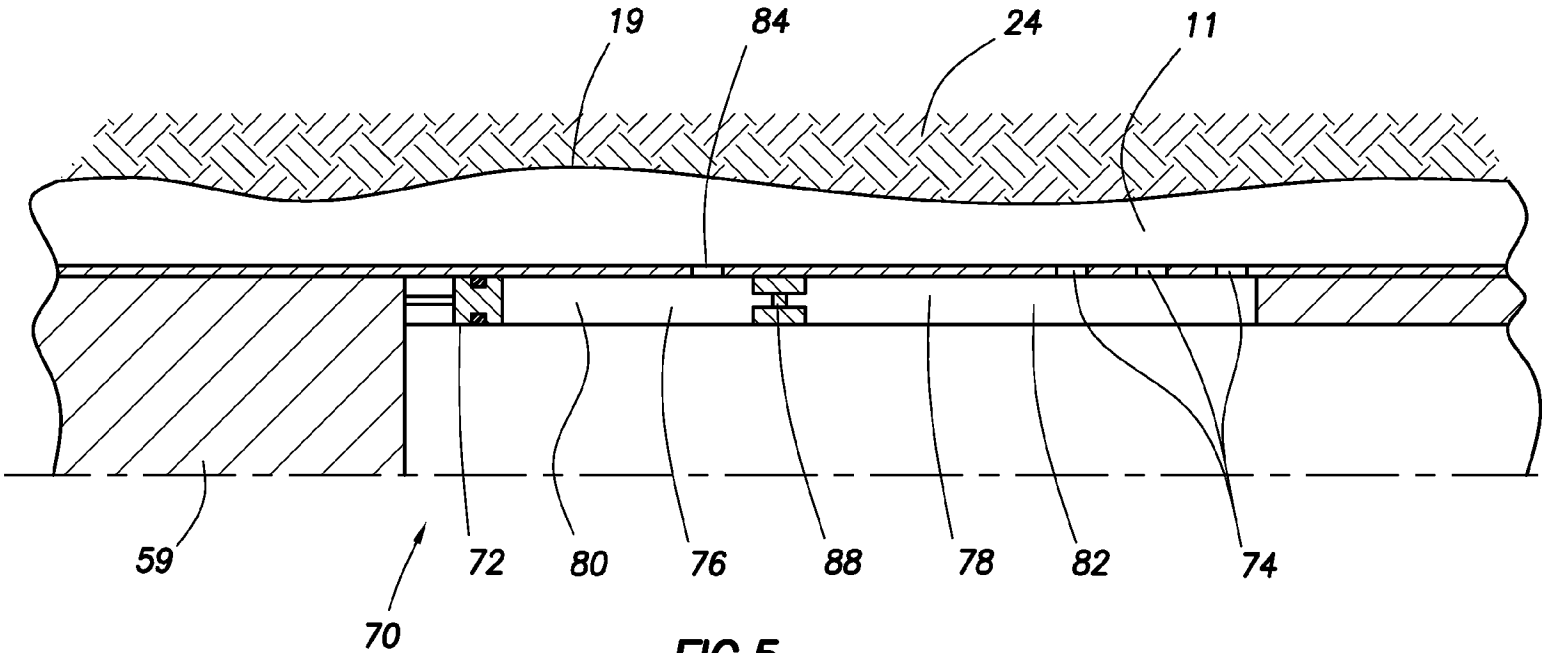
FIG. 5 is a cross-section view of an exemplary delivery assembly according to an aspect of the invention.

FIG. 5 is a cross-sectional view of an exemplary delivery assembly according to an aspect of the invention. A tubular assembly 70 extends through the wellbore annulus 11 defined by wellbore wall 19 in zone 24. An actuator 59 drives a cylindrical piston assembly 72 when actuated. As explained above, the actuator can be of any kind known in the art. The piston assembly 72, when actuated, drives the annular barrier forming material 54 into the wellbore annulus 11 by one or more ports 74. The annular barrier forming material 54 is carried in one or more compartments 76 and 78.

One or multiple compartments may be used. For example, where the annular barrier forming material 54 is comprised of two (or more) chemical compounds 80 and 82, which, when mixed with one another, react to create an annular barrier, the compounds 80 and 82 can be carried in separate compartments 76 and 78. In a preferred embodiment, the compartments 76 and 78 are separated by an isolation device 88 separating the compounds. The isolation device 88 can be a valve, breakable barrier, etc., operated by pressure created by movement of the piston assembly or operated by other mechanisms known in the art.

In another embodiment, where the annular barrier forming material 54 is a chemical compound which reacts in the presence of a catalyst, the chemical compound is carried in one of the compartments 76 or 78 and the catalyst in the other compartment.

Similarly, in an embodiment where the annular barrier forming material 54 is a solid, powder, or gel which requires a mixing fluid to flow the material into the wellbore, the material 54 can be carried in compartment 78 and the mixing fluid in compartment 76. Where the annular barrier forming material 54 is to be mixed with or exposed to in situ wellbore fluids, the material 54 can be exposed to in situ fluids in the wellbore without prior mixing.

In an alternate embodiment, the catalyst can be radiation, such as UV or electromagnetic radiation.

In FIG. 5, the exemplary assembly flows the annular barrier forming material into the annulus 11 through ports 74 in compartment 78. It is to be understood that chemical compounds, catalysts, mixing fluids, and/or the annular barrier forming material can be combined in the wellbore; that is, flowed into the wellbore and then mixed or combined. Further, the compounds, catalysts, and/or materials can be flowed into the wellbore simultaneously or sequentially. For example, the actuator 59 can be utilized to flow fluid from compartment 76 through port 84 and also to flow fluid from compartment 78 through ports 74.

Not illustrated herein, but seen in U.S. Pat. No. 6,854,522, which is incorporated by reference for all purposes, is a bypass conduit extending along the outer surface of tubing. It is often desirable in well completions to provide control, signal, power, etc. lines from the surface to down hole equipment. The lines may be copper or other conductive wires for conducting electrical power down hole or for sending control signals down hole and signals from pressure, temperature, etc. sensors up hole. Fiber optic lines may also be used for signal transmissions up or down hole. The lines may be hydraulic lines for providing hydraulic power to down hole valves, motors, etc. Hydraulic lines may also be used to provide control signals to down hole equipment. The bypass conduit may be any other type of line, e.g. a chemical injection line, used in a down hole environment. It is usually preferred to route these lines on the outside of the tubing rather than in the production flow path up the center of the tubing.

In the figures, the packers are illustrated by a representative "X" between two lines. It is to be understood for purposes of this document, that these may also represent other types of flow restrictors, such as cement baskets, "umbrellas," elastomeric rings extending from the surface of the tubing assembly, and the like, which restrict flow of the annular barrier forming material in the annulus sufficiently to allow the material to set into an annular barrier 50 before flowing away down the wellbore. The flow restrictors can be deployed after gravel packing the wellbore. The flow restrictors, whether packers or otherwise, are used to position the annular barriers 50 within the wellbore. The flow restrictors, as the name implies, restrict flow of the annular barrier forming material, but need not necessarily seal against the wellbore wall.

Figure 6:
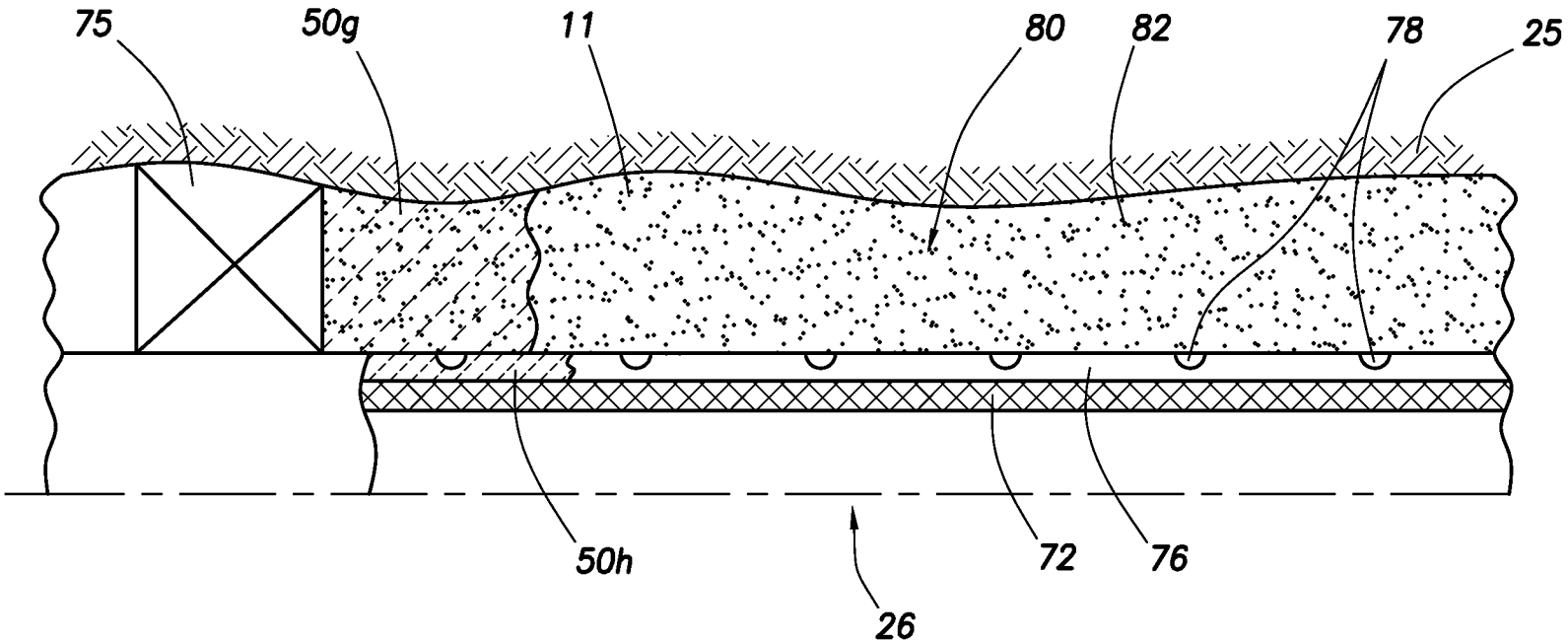
FIG. 6 is a partial cross-sectional view of an exemplary embodiment of the invention having alternate path conduits It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear either explicitly or from context. Uphole and downhole are used to indication location or direction in relation to the surface, where uphole indicates relative position or movement towards the surface along the wellbore and downhole indicates relative position or movement further away from the surface along the wellbore.

FIG. 6 is a partial cross-sectional view of a tubing assembly, including alternate path conduits, extending through a target zone, with an annular barrier formed according to one aspect of the invention. The tubing assembly 26 is positioned in the wellbore 10 along a target zone 25. A flow restrictor, packer 75, is positioned in the wellbore annulus. The tubing assembly 26 includes a perforated tubing assembly 70 having a screen assembly 72. An optional perforated shroud can be used. Alternate path perforated conduits 76 are provided axially along the tubing assembly exterior to the screen assembly. Alternate path conduits 76 are well-known in the art and are not explained in detail herein. The alternate path conduits 76 are utilized to provide an alternate flow path for fluids along the wellbore.

One type of alternate path conduits are shunt tubes, as shown, and provide an alternate fluid flow path during gravel packing operations. Use of shunt tubes during gravel packing is well known in the art and not explained in detail herein. The following patents provide information regarding alternate path conduits, shunt tubes and gravel packing using shunt tubes and are incorporated herein by reference for all purposes: U.S. Pat. Nos. 4,945,991 to Jones, 5,890,533 to Jones, 5,113,935 to Jones, 6,481,494 to Dusterhoft, and 7,784,532 to Sevre.

A system may utilize shunt tubes or other alternate path conduits for deployment of treatment fluids into the annulus prior to the placement of the annular barrier forming material. For example, shunt tubes 76, having perforations 78 for allowing fluid flow into and out of the shunt tube interior, run along the length of the tubing assembly and are often used for deploying gravel-bearing slurry in a gravel packing process. The shunt tubes may be positioned along the exterior of the tubing assembly, inside a protective shroud, adjacent a screen assembly, etc. The shunt tubes have a plurality of openings 78 for flow of the gravel slurry along the annulus during gravel packing operations resulting in gravel pack 80 comprising gravel pack media 82. After use in gravel packing, the shunt tubes 76 may still provide a fluid flow path from the annulus along the target zone to other locations where fluid flow is not desired, such as to other zones, to the interior of the tubing assembly, etc. In such a case, it is often desirable to restrict fluid flow through the already-utilized shunt tubes. The annular barrier forming material 50 is delivered to the annulus 11 and annular barrier 50*g* is created as described above. Additionally, in a preferred embodiment, the annular barrier forming material also creates a barrier 50*h* restricting fluid flow through the shunt tubes 76. The annular barrier forming material can flow into the shunt tubes directly from the tubing assembly. Alternately, the material can be flowed into the annulus and then through the shunt tube perforations 78 into the shunt tubes 76.

In some cases, a bypass conduit (not shown) may be provided along the wellbore passing through or bypassing a flow restrictor, such as a packer, or annular barrier, to allow controlled flow of certain materials, e.g. hydraulic fluid, or housing other structures, such as fiber optic cables. The annular barrier forming material can, in a preferred embodiment, act to seal such bypass conduits from leakage of fluid from the wellbore annulus.

CONCLUSION

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. While the descriptions above tend to refer to positioning of annular barriers for purposes of hydrocarbon fluid production, it is to be understood that the annular barriers can also be used in well injection, completion and work-over processes as well. It is, therefore, intended that the appended claims encompass any such modifications or embodiments.

What is claimed is:

1. A method of completing a subterranean well having an open wellbore extending through a subterranean formation having a target zone, the method comprising the steps of:

placing a tubing assembly in the open wellbore, the tubing assembly extending through the target zone, the tubing assembly having an outer surface and defining an interior passageway extending through the target zone, an annular space defined between the outer surface of the tubing assembly and the wellbore wall;

positioning at least one annular flow restrictor in the annular space adjacent the target zone;

placing a gravel pack in the annular space along at least a length of the target zone and adjacent at least one annular flow restrictor;

then flowing an annular barrier forming material from the interior passageway into the annular space occupied at least in part by the gravel pack and adjacent at least one annular flow restrictor, the annular flow restrictor at least partially restricting flow of the annular barrier forming material along the annular space; and then setting the annular barrier forming material in the annular space and adjacent at least one annular flow restrictor, and creating an annular barrier in the annular space and leaving the interior passageway open; and then flowing a fluid through the interior passageway.

2. A method as in claim 1 wherein the tubing assembly further comprises perforated tubing assembly extending along the target zone.

3. A method as in claim 2 wherein the perforated tubing assembly includes at least one screen assembly.

4. A method as in claim 1 further comprising a step of storing the annular barrier forming material in a compartment in the tubing assembly.

5. A method as in claim 1 further comprising a step of pumping the annular barrier forming material into the annular space.

6. A method as in claim 5 further comprising a step of pumping the annular barrier forming material from the surface to downhole adjacent the target zone and into the annular space.

7. A method as in claim 1 wherein the annular flow restrictor is a packer.

8. A method as in claim 1 wherein the annular flow restrictor restricts flow of the annular barrier forming material until the annular barrier forming material sets.

9. A method as in claim 1, further comprising performing the step of positioning at least one annular flow restrictor after the step of placing a gravel pack in the wellbore.

10. A method as in claim 1 wherein the annular barrier forming material is at least partially comprised of a material selected from the group consisting of polymers, silicones, and resins.

11. A method as in claim 1 wherein the annular barrier forming material sets in the presence of at least one chemical catalyst.

12. A method as in claim 1 wherein the annular barrier forming material includes at least two chemical compounds which, when mixed together, create the annular barrier.

13. A method as in claim 1, further comprising flowing an annular barrier forming material into the annular space at a plurality of locations along the wellbore; and then setting the annular barrier forming material at the plurality of locations and creating annular barriers at the locations.

14. A method as in claim 1, wherein the gravel pack comprises gravel pack media, the step of flowing an annular barrier forming material further comprises a step of flowing the annular barrier forming material through the gravel pack media, surrounding individual media of the gravel pack with annular barrier forming material; and wherein the step of creating an annular barrier further comprises creating an annular barrier having gravel pack media positioned within the annular barrier.

15. A method as in claim 14, further comprising a step of utilizing the gravel pack media positioned in the annular barrier as a structural component of the annular barrier.

16. A method as in claim 1 further comprising the step of flowing annular barrier forming material into the annular space along a length of the wellbore free of gravel pack.

17. A method as in claim 1, wherein the step of flowing annular barrier forming material further comprises a step of flowing the annular barrier forming material into the annular space on a side of at least one flow restrictor wherein the annular space is substantially free of gravel pack media.

18. A method as in claim 1, wherein the tubing assembly further comprises at least one alternate path conduit extending axially along the tubing assembly, and further comprising the step of flowing annular barrier forming material into the at least one alternate path conduit, and further comprising the step of creating an annular barrier in the at least one alternate path conduit with the annular barrier forming material.

* * * * *